US008869313B2

(12) United States Patent
Maramotti

(10) Patent No.: US 8,869,313 B2
(45) Date of Patent: Oct. 28, 2014

(54) POCKET FOR ARTICLES OF CLOTHING, A METHOD FOR REALISING A POCKET AND RELEVANT ARTICLES OF CLOTHING

(75) Inventor: Luigi Maramotti, Albinea (IT)

(73) Assignee: Max Mara S.R.L. Societa' Unipersonale, Reggio Emilia (IT)

( * ) Notice: Subject to any disclaimer, the term of this patent is extended or adjusted under 35 U.S.C. 154(b) by 307 days.

(21) Appl. No.: 13/187,893

(22) Filed: Jul. 21, 2011

(65) Prior Publication Data

US 2012/0023644 A1 Feb. 2, 2012

(30) Foreign Application Priority Data

Jul. 30, 2010 (IT) ..... RE2010A0062

(51) Int. Cl.
*A41D 27/20* (2006.01)
*A41D 1/06* (2006.01)

(52) U.S. Cl.
CPC *A41D 27/20* (2013.01); *A41D 1/06* (2013.01); *A41D 2400/38* (2013.01)
USPC ..... 2/247

(58) Field of Classification Search
USPC ..... 2/247, 248, 249, 250, 251, 252, 253, 2/254, 227, 228, 238, 403; 112/475.09
See application file for complete search history.

(56) References Cited

U.S. PATENT DOCUMENTS

| | | | | | |
|---|---|---|---|---|---|
| 1,504,607 | A * | 8/1924 | Cornblum | 2/247 |
| 1,550,331 | A * | 8/1925 | Baker | 2/248 |
| 2,468,915 | A * | 5/1949 | Bayless | 2/247 |
| 2,988,750 | A * | 6/1961 | Reed | 2/254 |
| 3,163,867 | A * | 1/1965 | Halcomb | 2/248 |
| 3,435,462 | A * | 4/1969 | Bank | 2/227 |
| 3,996,622 | A | 12/1976 | Cooke | |
| 4,404,689 | A * | 9/1983 | DeWan | 2/247 |
| 4,446,573 | A * | 5/1984 | Green | 2/252 |
| 5,105,477 | A * | 4/1992 | Golde | 2/93 |
| 5,535,451 | A * | 7/1996 | Tassone et al. | 2/227 |
| 5,588,385 | A * | 12/1996 | Sand | 112/475.09 |
| 5,713,292 | A * | 2/1998 | Wong | 112/441 |
| 6,138,595 | A * | 10/2000 | Croyle et al. | 112/475.06 |
| 6,253,379 | B1 * | 7/2001 | Collier | 2/108 |
| 6,421,831 | B1 * | 7/2002 | Korff | 2/69 |

(Continued)

FOREIGN PATENT DOCUMENTS

GB 191405166 A 7/1914

*Primary Examiner* — Alissa L Hoey
(74) *Attorney, Agent, or Firm* — Pearne & Gordon LLP

(57) ABSTRACT

A pocket for articles of clothing provided with an upper edge 2, a lower edge 3 and a first and a second lateral edges 4, 5. In a non-assembled configuration, the pocket comprises is defined by a first portion 6 exhibiting a first edge 8, and a second portion 7 exhibiting a second edge 9. A seam 10 realizes an assembled configuration by the joining of the first portion 6 to the second portion 7, by the superposition of an edge 8 on the other one 9 and the nearing of an edge 8 to the other one 9 to give the pocket a curved three-dimensional conformation.

Said pocket 1 being obtained by a nearing step of the first portion 6 to the second portion 7 and a connecting step thereof.

Said pocket 1 being applied to trousers 14, such as to be superposed during use on a buttock of the person wearing the trousers.

Said pocket 1 being applied to a shirt 25, such as to be superposed during use on the breast of the person wearing the shirt.

7 Claims, 6 Drawing Sheets

(56) References Cited

U.S. PATENT DOCUMENTS 7,845,021 B2 * 12/2010 del Carmen Erana Ahumada ..... 2/227
8,276,213 B2 * 10/2012 Maurer ..... 2/97
8,407,816 B2 * 4/2013 Rhoades, II ..... 2/253
2004/0205879 A1 * 10/2004 Leba ..... 2/247
2009/0288240 A1 * 11/2009 Lim ..... 2/403

* cited by examiner

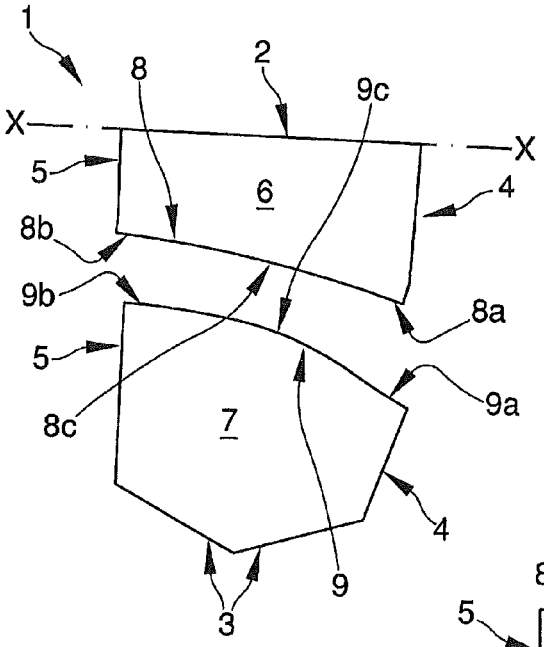
Fig. 1
Fig. 2
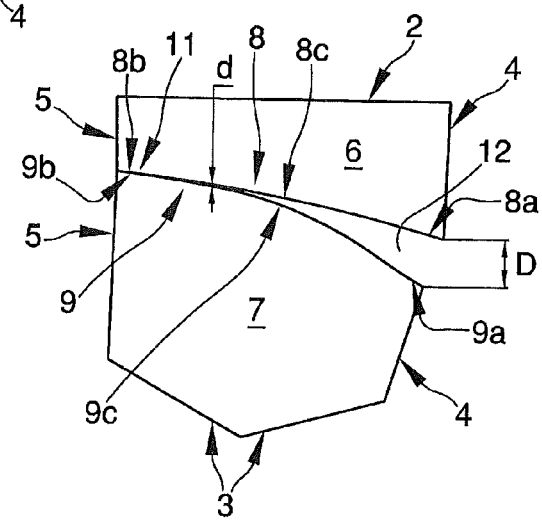
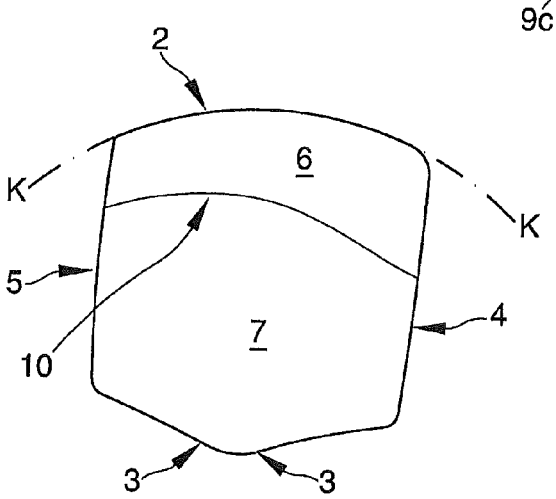
Fig. 3

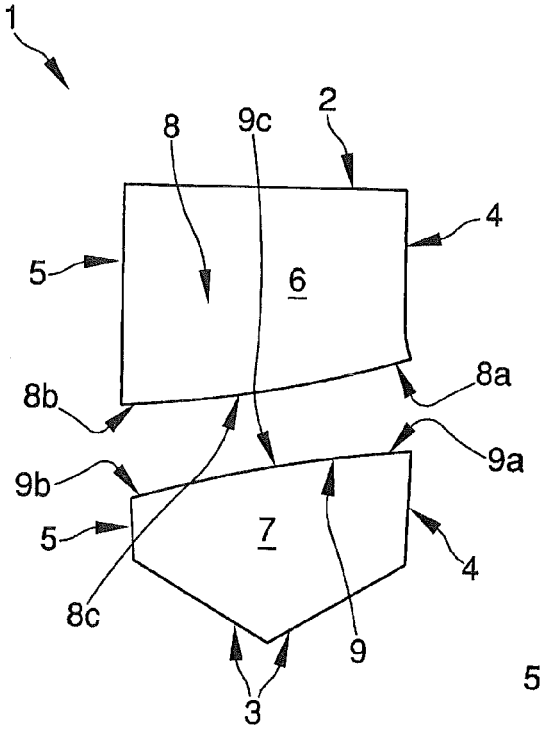
Fig. 4
Fig. 5
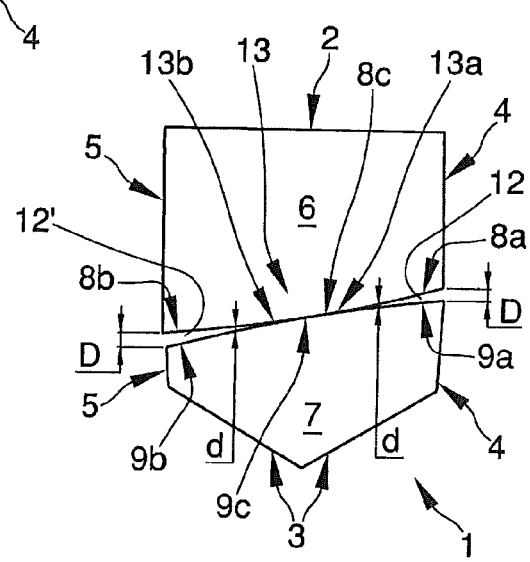
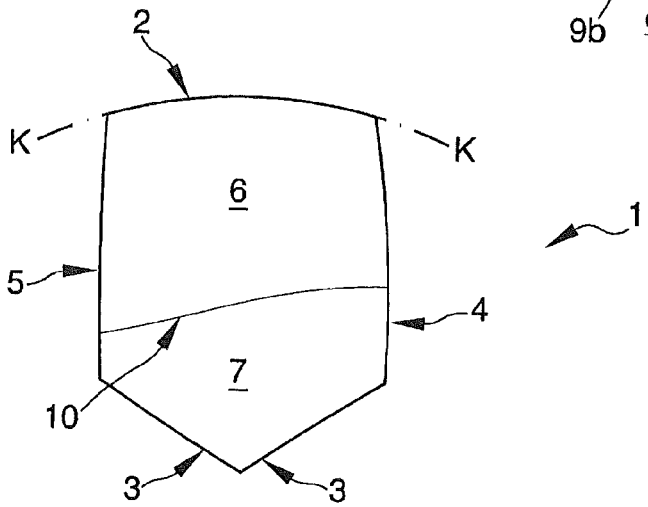
Fig. 6

POCKET FOR ARTICLES OF CLOTHING, A METHOD FOR REALISING A POCKET AND RELEVANT ARTICLES OF CLOTHING

The invention concerns a pocket that can be applied on an article of clothing in a position which, when the article is worn by a person, is superposed on a projecting part of the body of the wearer, said projection being delimited by a curved three-dimensional surface.

The pocket of the invention is especially suitable for application on a rear portion of a pair of trousers such as to be superposed on a buttock of the person wearing the trousers, or on a front portion of a jacket, blouse or gilet such as to be superposed on a breast.

A further object of the present invention is a method for realising the pocket.

The invention further concerns an article of clothing on which the above-mentioned pocket is applied, especially a pair of trousers, a blouse or a jacket.

Among the most common types of trousers are jeans, which are especially favoured by both men and women because they are practical, wearable and fashionable.

Jeans of known type are provided with rear pockets, each of which is realised with a single piece of cloth which is sewn along the edge thereof to the underlying cloth. After being sewn on the jeans, the pocket therefore takes on a substantially flat conformation.

When the jeans are worn, notwithstanding the deformability of the cloth, the rear pocket—because of its flat conformation—cannot adapt perfectly to the curved surface of the buttock. This reduces the comfort of the user, who might feel a crushing of the buttock exerted by the pocket. Further, the rear pocket tends to flatten the buttock, with an effect that can be aesthetically unappealing.

Like defects occur with pockets made with a flat piece of cloth and applied on jackets or shirts at the breast position of the user.

An aim of the invention is to improve the pockets suitable for being applied on an article of clothing such as to be positioned, when the article is worn, on a curved surface that projects from the body of the user.

A further aim is to reduce the crushing action exerted on curved surfaces of the body of a user by a pocket applied on an article of clothing.

A still further aim of the invention is to increase the comfort of articles of clothing provided with pockets that are suitable for being positioned on a curved surface of the user's body.

A further aim is to provide a pocket for an article of clothing which, when positioned at a curved surface of the user's body, enhances the three-dimensional curvature of the surface, producing a pleasant aesthetic effect.

Thanks to the invention, a pocket can be obtained which can adapt to a user's breast or buttock curvature on the article the pocket is applied on.

This enables an increase in user comfort, as the article of clothing is highly wearable even at the pocket position, and the user feels no crushing sensation as is sometimes the case with flat pockets of known type.

Further, the pocket of the invention enables emphasising the curves of the user's body, making the article of clothing to which the pocket is applied particularly appreciable from the aesthetic point of view.

The invention will be better understood and actuated with reference to the accompanying drawings, which illustrate some versions thereof by way of non-limiting examples, in which:

FIG. 1 is a view showing the flat development of a first portion and a second portion of a pocket, according to the present invention, in a non-assembled configuration;

FIG. 2 is a view showing the first portion and the second portion of FIG. 1 arranged in contact on a plane;

FIG. 3 is a perspective view of a pocket obtained by joining the first portion and the second portion of FIG. 2, realising an assembled configuration of the pocket;

FIG. 4 is a view showing the flat development of a first portion and a second portion of a second embodiment of the pocket of FIG. 1, in a non-assembled configuration;

FIG. 5 is a view illustrating the first portion and the second portion of FIG. 4 arranged in contact on a plane;

FIG. 6 is a perspective view of the second embodiment of the pocket of FIG. 4 obtained by joining the first portion and the second portion, thus realising an assembled configuration;

Figure 7:
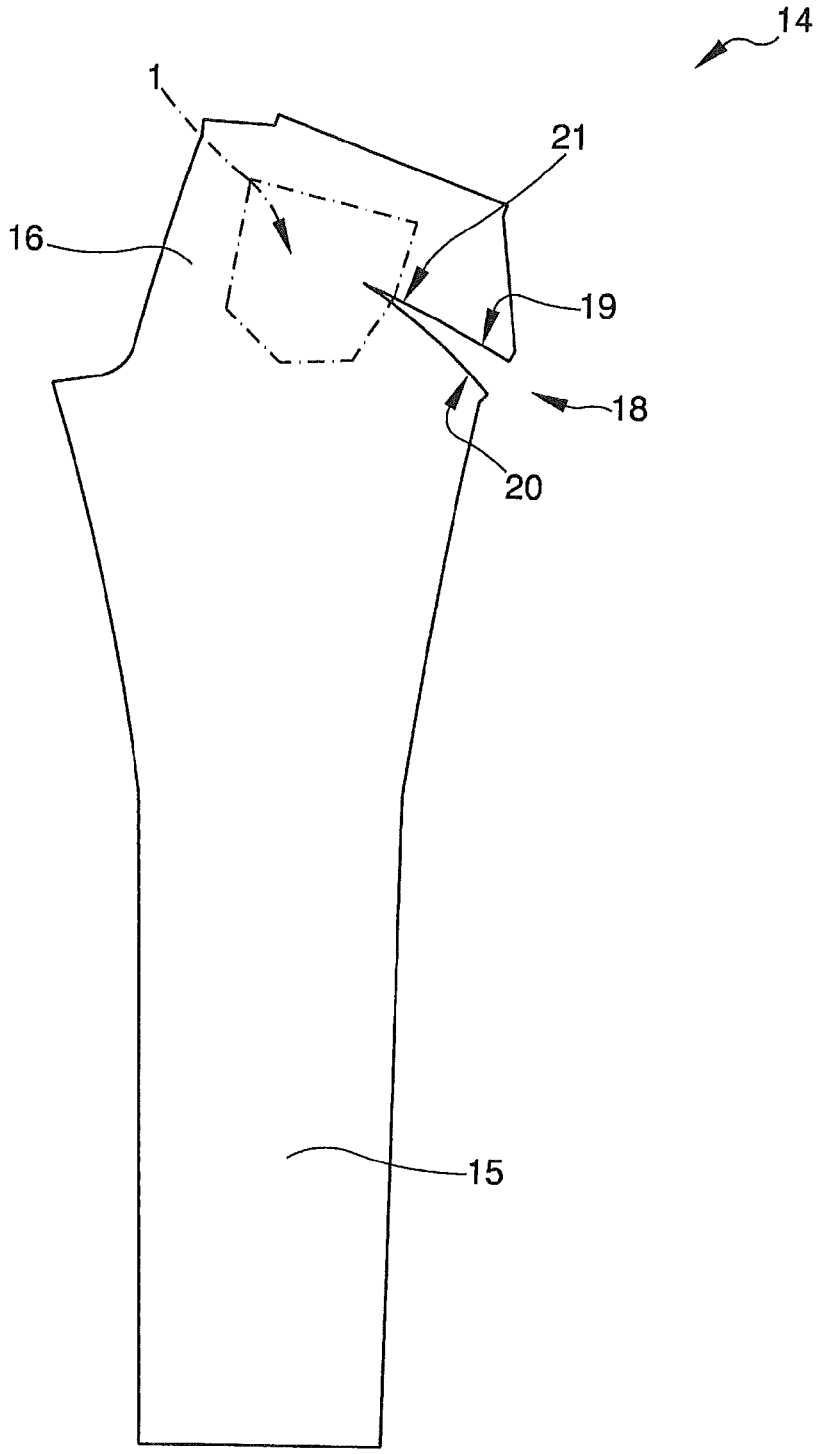
FIG. 7 is a view showing the flat development of a piece of cloth destined to form a rear portion of a leg of a pair of trousers.
Figure 8:
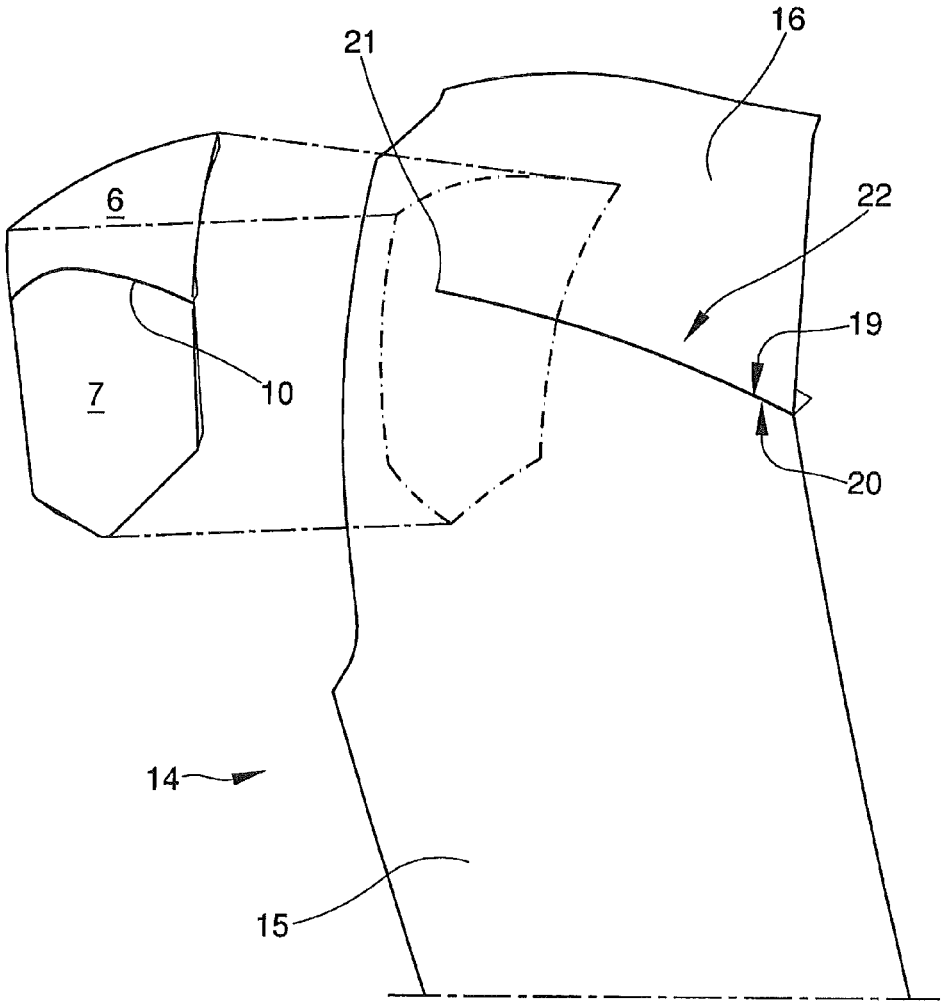
FIG. 8 is an exploded perspective view showing the pocket of FIG. 1 and the rear portion of the trousers of FIG. 7.

With reference to FIGS. 1-6, 1 denotes in its entirety a pocket which is the object of the present invention.

With particular reference to FIGS. 1, 2, 4, 5, the pocket 1 is illustrated in a non-assembled configuration, while with reference to FIGS. 3, 6 the pocket is illustrated in an assembled configuration.

In both configurations, said pocket 1 is defined by an upper edge 2, a lower edge 3 and a first and a second lateral edge 4, 5.

The above-cited edges 2, 3, 4, 5 define a perimeter profile P of the pocket 1 which is closed when the pocket 1 is in the assembled configuration.

The upper edge 2 is opposite the lower edge 3.

The upper edge 2 exhibits, in the non-assembled configuration of the pocket 1, a linear extension along an axis X-X.

On the contrary, the upper edge 2 exhibits, in the assembled configuration of the pocket 1, an arched extension along an arc K-K.

The lower edge 3 exhibits, in both configurations taken on by the pocket 1, a broken-lined progression, defined by two tracts converging in a point, assuming a V-shape.

The two lateral edges 4 and 5 are opposite one another and interposed between the upper edge 1 and the lower edge 3 in order to connect them together.

In the non-assembled configuration the first and second lateral edges 4, 5 are not parallel to one another.

More precisely, in the non-assembled configuration, the second lateral edge 5 exhibits a vertical development, while in the first lateral edge 4 it exhibits a development, starting from the lower edge 3, in a distancing direction with respect to the second lateral edge 5.

In other words, the first lateral edge 4, starting from the lower edge 3, extends towards the upper edge 2 while diverging from the second lateral edge 5.

In the assembled configuration the first and second lateral edges 4, 5 take on a parallel configuration as is visible in the accompanying FIGS. 3, 6.

The pocket 1, in the non-assembled configuration, is defined by a first portion 6 and a second portion 7.

As can be seen in FIGS. 2, 4 the first and second portion 6, 7 are sourced from two separate pieces of cloth.

It is clear that without forsaking the ambit of protection of the present invention, the first and second portion 6, 7 can be joined to one another in a section and separate in the other section, thus realising the non-assembled and assembled configurations dealt with during the course of the description.

Said first and second portions 6, 7 respectively comprise a first edge 8 and a second edge 9, facing one another.

Said edges 8, 9 are complementarily shaped to one another.

The first edge 8 comprises a first terminal tract 8*a*, a second terminal tract 8*b* and a median tract 8*c* located between and conjoining the terminal tracts 8*a*, 8*b*.

Likewise the second edge 9 too comprises a first terminal tract 9*a*, a second terminal tract 9*b* and a median tract 9*c* located between and conjoining the terminal tracts 9*a*, 9*b*.

To complete the pocket 1 there is a seam 10, defining an assembled configuration of the pocket, arranged along the first edge 8 and the second edge 9.

Said assembled configuration of the pocket can be obtained, without forsaking the ambit of protection of the present invention, with any other type of connection such as for example gluing, Velcro, or a zip.

The complementary shaping of the first and second edge 8, 9 is such as to realise, during the lining-up of the two portions 6, 7, a particular condition, which will be explained in the following.

As can be seen in FIG. 2, the first portion 6 and the second portion 7 exhibit a flat development such that if the first edge 8 and the second edge 9 are arranged on a plane in reciprocal contact in at least a contact point 11, at least two terminal tracts 8*a*, 9*a*, each belonging to the respective edge 8, 9, are separated from one another in a separation zone 12 which broadens from said contact point 11 towards the lateral edge 4 of the pocket 1.

At the contact point 11 the distance d between the terminal tracts 8*a*, 9*a* is at a minimum, while at the lateral edge 4 the distance D between the terminal tracts 8*a*, 9*a* is at a maximum.

The minimum distance d at the contact point is about 0 mm.

The maximum distance D at the lateral edge 4 is comprised between 5 mm and 40 mm and is preferably 15 mm.

As can be seen in FIG. 2, the configuration of the edges 8, 9 of the pocket 1 is such that when the contact point 11 has been realised, the first terminal tracts 8*a*, 9*a* diverge while the second terminal tracts 8*b*, 9*b* coincide.

In this particular configuration the development of the median tracts 8*c*, 9*c* is pointed.

The seam 10, at the separation zone 12, facilitates the joining of the first portion 6 to the second portion 7 by nearing the at least two terminal tracts of edge 8*a*, 9*a* such as to give the pocket a curved three-dimensional conformation.

More precisely, the seam 10 enhances the joining of the first portion 6 to the second portion 7 by a superposing of the edge 8 on the edge 9, at the contact point 11, and the nearing of the edge 8 to the edge 9, at the separation zone 12, in order to give a curved three-dimensional conformation.

The joining of the first portion 6 to the second portion 7, by means of the seam 10, produces a convex shape of the pocket 1, i.e. it exits from the plane on which it rests (which in the drawing of FIG. 3 is the plane of the sheet of paper).

With reference to the seam 10 realised at the separation zone 12 it is made by rotation, with respect to the contact point 11 of the first terminal tract 8*a* towards the second terminal tract 9*a* up to generating contact of the above-mentioned tracts.

The effect obtained by the seam 10 is visible in FIG. 3, in which the pocket 1 is illustrated in the assembled configuration, where the three-dimensional aspect of the pocket 1 can be seen, i.e. the concavity of the pocket projecting from the sheet.

With reference to the embodiment of FIG. 4, in which a second embodiment of the pocket 1 is illustrated, the conformation of the edges 8, 9 is such as to realise a more accentuated effect with respect to what can be obtained by the pocket in the first embodiment.

As can be seen in FIG. 5, the nearing of the edges 8, 9 generates a contact segment 13 in place of the contact point 11, and a first and a second separation zone 12, 12'.

Said contact segment 13 is obtained by reciprocal contact of the median tracts 8*c*, 9*c* which in this case take on a linear development.

Said contact segment 13 is defined by a first end 13*a* and a second end 13*b*.

In other words, in the example of FIG. 4, the first and the second portion 6, 7 exhibit a flat extension, such that if the first edge 8 and the second edge 9 are arranged on a plane of reciprocal contact the contact occurs with the median tracts 8*c*, 9*c* of the edges.

The generation of the contact segment 13, by nearing the median tracts 8*c*, 9*c*, promotes a contextual appearance of a first separation portion 12 and a second separation portion 12'.

The first separation portion 12 is obtained by the flanking of the first terminal tracts 8*a*, 9*a*.

Said first separation portion 12 tends to broaden from the contact segment 13 towards the lateral edge 4.

In other words, at the contact segment 13, at the first end 13*a*, the distance d between the terminal tracts 8*a*, 9*a* is at a minimum, while at the lateral edge 4 the distance D between the terminal tracts 8*a*, 9*a* is at a maximum.

Likewise the second separation portion 12' is obtained by flanking the second terminal tracts 8*a*, 9*b*.

Said second separation portion 12' tends to broaden from the contact segment 13 towards the lateral edge 5.

In other words, at the second end 13*b* of the contact segment 13, the distance d between the second terminal tracts 8*b*, 9*b* is at a minimum, while at the lateral edge 5 the distance D between the terminal tracts 8*b*, 9*b* is at a maximum.

In this case too, as mentioned above, the minimum distance d at the ends 13*a*, 13*b* of the contact segment 13 is 0 mm, while the maximum distance D at both lateral edges is comprised between 5 mm and 40 mm and is preferably 1.5 mm.

The broadening of the first portion 12 is specular to the broadening of the second portion 12'.

More precisely, the broadening of the first portion 12 develops in the opposite direction to the development direction of the broadening of the second portion 12'.

In the configuration of FIGS. 4-6, the seam 10 facilitates the joining of the first portion 6 to the second portion 7 by superposing of the median tracts 8*c* and 9*c* and the nearing of the first terminal tracts 8*a*, 9*a* and the second terminal tracts 8*b*, 9*b*, at the respective first and second separation portion 12, 12'.

With particular reference to the nearing of the first and second terminal tracts 8*a*, 8*b*,9*a*, 9*b* during the realisation of the seam 10, the first terminal tract 8*a* of the first edge 8 is rotated, with respect to the first end 13*a* of the contact segment 13, towards the first terminal tract 9*a* or the second edge 9, up to generating contact between the above-mentioned tracts, and the second terminal tract 8*b* of the first edge 8 is rotated with respect to the second end 13*b* of the contact segment 13 towards the second terminal tract 9*b* of the second edge 9 up to generating contact of the above-mentioned tracts.

In this case too, the joining of the first portion 6 to the second portion 7, by means of the seam 10, causes a convex shape of the pocket 1, i.e. exiting from the plane on which it rests (which in the drawing of FIG. 6 is the plane of the sheet of paper).

The method for realising the pocket, realised according to the first embodiment, comprises following steps:

nearing the first portion 6 to the second portion 7, placing the first edge 8 in contact with the second edge 9 at least at a contact point 11 and generating a separation zone 12, between the first edge 8 and the second edge 9 at the respective first terminal tracts 8*a*, 9*a*, which widens from the point of contact 11 towards the lateral edge 4 of the pocket 1;

connecting the first portion 6 to the second portion 7, at the respective edges 8, 9, facilitating a connection extending between the lateral edges 4, 5, superposing the first edge 8 on the second edge 9 at the contact point 11, and nearing the first edge 8 to the second edge 9, at the separation zone 12.

The connecting step is carried out by preferably making a seam 10.

The seam 10 is realised by using the superposing of the edges 8, 9, obtained by nearing the edges 8, 9 in the at least a contact point 11, and by means of the nearing of the first terminal tracts 8*a*, 9*a* and sewing them in contact with one another.

With particular reference to the seam 10 realised at the terminal tracts 8*a*, 9*a*, the seam 10 is sewn by nearing the edges obtained by rotating the first edge 8 towards the second edge 9 with respect to the contact point 11.

In other words the operator performs a partial sewing at the contact point 11 and thereafter finishes the sewing operation at the separation zone 12.

As can be seen in FIGS. 2 and 3, the partial sewing is done starting from the second lateral edge 5 up to reaching the contact point 11.

The following sewing, to complete the seam 10, is done starting from the contact point 11 towards the first lateral edge 4 nearing progressively, by a rotation of the first terminal tract 8*a* towards the second terminal tract 9*a*, the edge 8 to the edge 9 up to placing them in contact with one another.

In the case of the second embodiment of the pocket 1, illustrated in FIGS. 4-6, the method is different from the one described herein above exclusively because of the different realisation of the connecting step.

The nearing of the edges 8, 9 is done by arranging the median tracts 8*c*, 9*c* in contact with one another, thus defining a contact segment 13.

The conformation of the edges 8, 9 is such as to generate a first separation portion 12, upstream of the contact segment 13, and a second separation portion 12', downstream of the contact segment 13.

The step of connecting, in the case of application of the seam 10, is done by sub-dividing the seam 10 first at the median tracts 8*a*, 9*c*, superposed on one another such as to define the contact segment 13, then by nearing the first terminal tracts 8*a*, 9*a* and the second terminal tracts 8*b*, 9*b* up to sewing them in contact with one another.

During the sewing of the separation portions 12, 12' a first tract of sewing is done starting from the first end 13*a* towards the first lateral edge 4, progressively nearing, by means of rotation, the first terminal tract 8*a* towards the second terminal tract 9*a*, then a second sewing tract from the second end 13*b* towards the second lateral edge 5, progressively nearing, by rotation, the first terminal tract 8*b* towards the second terminal tract 9*b*. The rotation of the first and the second terminal tracts 8*a*, 8*b* belonging to the first portion 6, with respect to the relative ends 13*a*, 13*b* of the contact segment 13, realises the contact with the respective terminal tracts 9*a*, 9*b* of the second portion 7.

With reference to possible articles of clothing provided with the pocket of FIGS. 1-6, FIG. 7 illustrates a rear portion or a leg of a pair of trousers 14.

The trousers 14 comprise a leg region 15 and a seat region 16, destined to be superposed on a buttock of a person wearing the trousers.

The pocket is sewn at the seat region 16, denoted in FIG. 7 with a broken and dotted line.

The seat region 16 is provided with a cut 18 defined by an upper flap 19 and a lower flap 20.

Starting from a vertex 21, located about in the centre of the seat region 16, the upper flap 19 and the lower flap 20 diverge from one another.

When the trousers 14 are realised, the upper flap 19 is sewn by superposing on the lower flap 20, realising a second seam 22.

Said seam is realised such as to generate a convexity on the seat region 16 in order to enable the trousers to adhere better to the buttock of the person wearing them.

Figure 9:
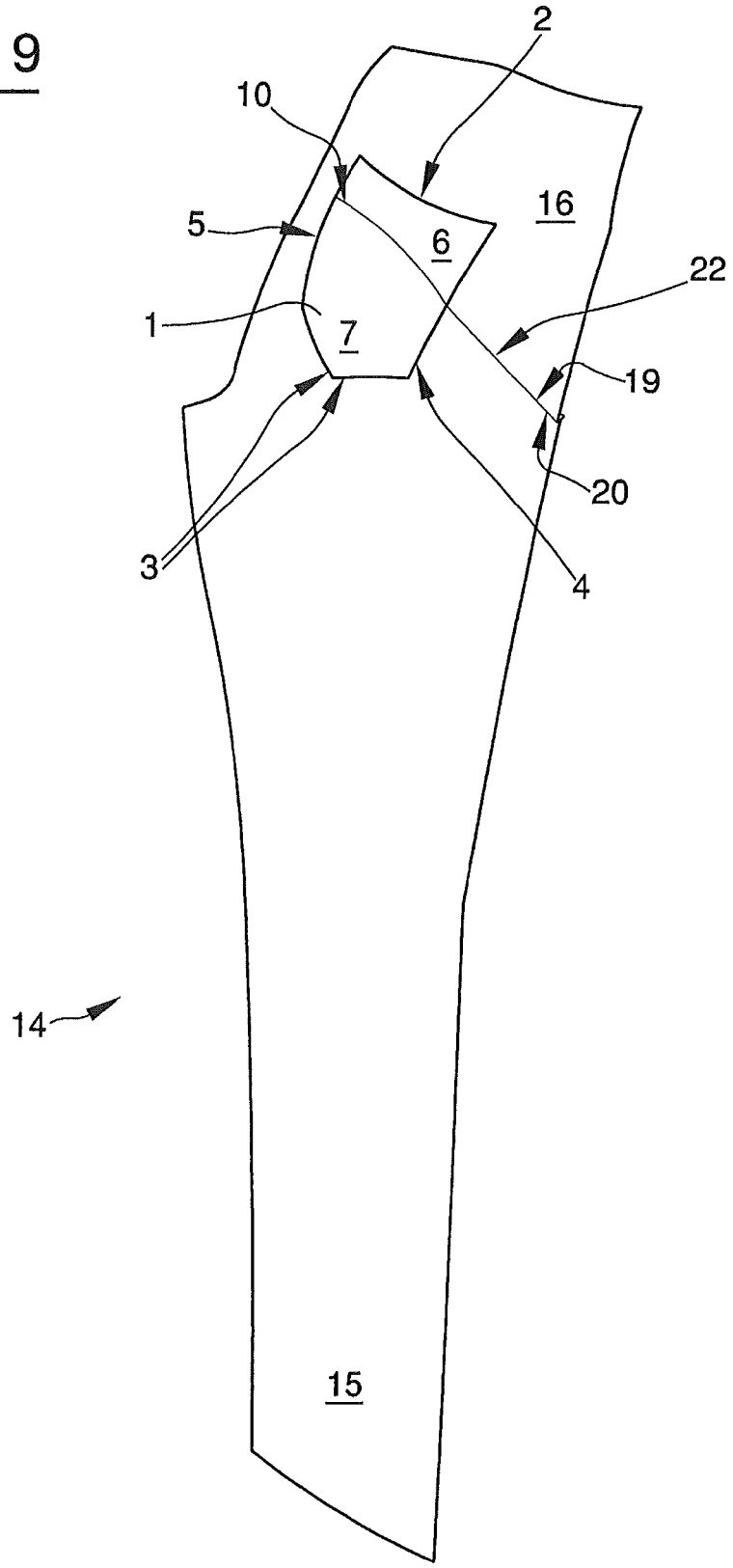
FIG. 9 is a perspective view showing a rear portion of a leg of a pair of trousers comprising the pocket of FIG. 1.

During application of the pocket 1 onto the seat region 16 of the trousers 14 particular attention is paid to superposing the seam 10 on the second seam 22 such that the first seam 10 creates a prolongation of the second, as illustrated in FIG. 9.

In this way the superposing of the two seams, 10, 22, enables the convexity of the seat region 16 of the trousers 14 to be enhanced.

Figure 11:
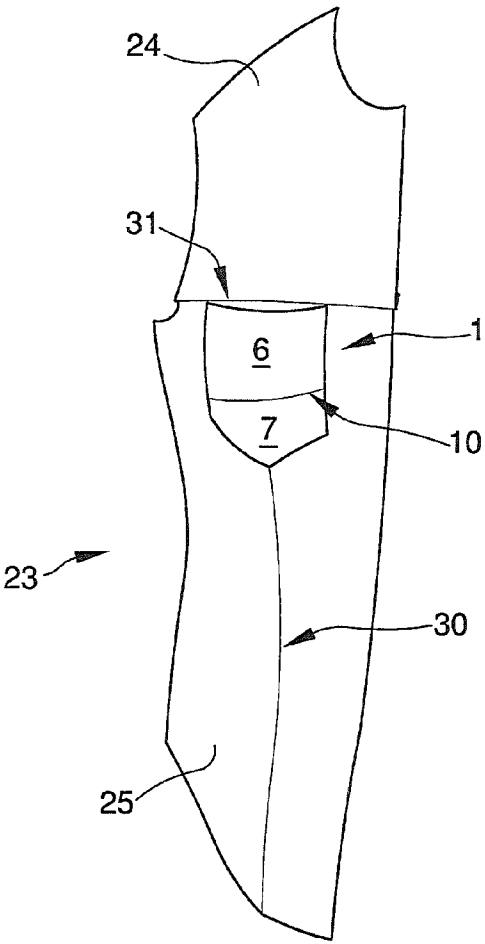
FIG. 11 is a perspective view illustrating a front part of a blouse comprising the pocket of FIG. 4.
Figure 10:
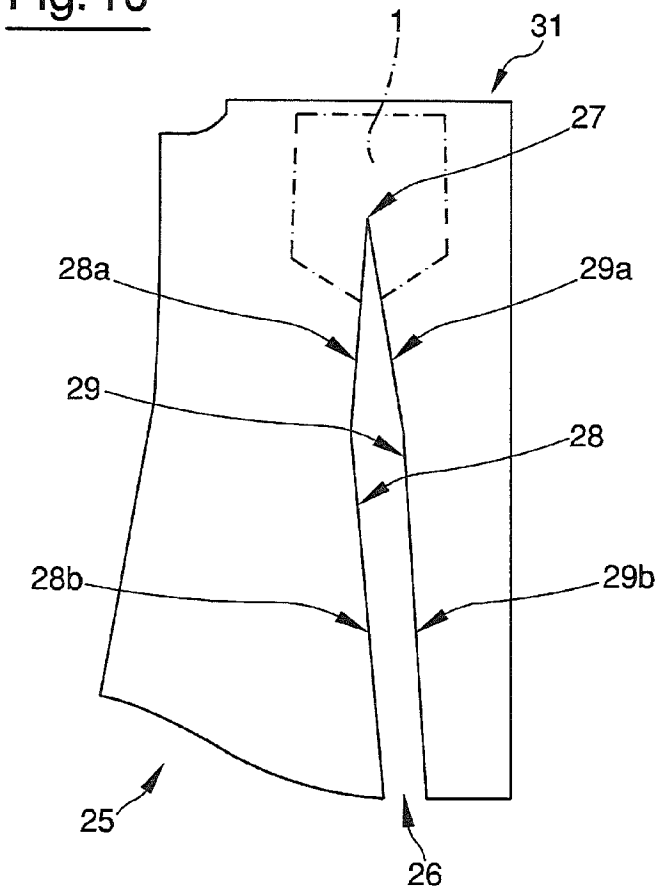
FIG. 10 is a view illustrating the flat development of a front portion of a blouse.

A further article of clothing provided with the pocket of FIGS. 1-6 is a shirt 23, illustrated in FIGS. 10-11.

Said shirt 23 superiorly exhibits a neck region 24 and a thorax region 25 connected inferiorly to the neck region 24 at a joining line 31.

At the thorax region 25 an opening 26 is afforded, exhibiting a vertex 27 from which two sides 28, 29 branch.

Said sides 28, 29 respectively exhibit a first portion 28*a* and a second portion 29*a*, diverging from one another, starting from the vertex 27, and continuing with a third portion 28*b* and a fourth portion 29*b*, converging towards one another.

Said sides 28, 29 are joined to one another such as to realise a pence 30 developing along the thorax region 25 from the base thereof up to reaching the top thereof.

The pocket 1 is located below the joining line 31 and superposed on the pence 30; the pocket 1 is located at the vertex. In FIG. 10 the pocket 1 is represented by a broken dotted line and sewn to the shirt 23 in FIG. 11. The pocket 1 and the method for realising thereof provide important advantages in the clothing sector.

From a point of view of comfort, the article, whether trousers 14 or a shirt 23, provided with the pocket 1 reduces the sensations of crushing localised in the curved surfaces of the user i.e. at the buttocks and breasts.

In addition, from an aesthetic point of view, the article tends to accentuate curvaceousness, while affording the body of the person wearing it an enhanced wearability.

The invention claimed is:

1. Trousers comprising a leg region (15), a seat region (16) and a pocket (1), wherein the pocket (1) is fixed to a portion of the seat region (16) of the trousers (14) corresponding to a buttock region of a person wearing the trousers, the pocket (1) comprising (a) a first portion (6) provided from a piece of flat material, said first portion (6) exhibiting a first edge (8)

defined by a first terminal tract (8*a*), a second terminal tract (8*b*) and a median tract (8*c*), and (b) a second portion (7) provided from a piece of flat material, said second portion (7) exhibiting a second edge (9) defined by a first terminal tract (9*a*), a second terminal tract (9*b*) and a median tract (9*c*), wherein a sewn seam (10) holds together the first edge (8) and the second edge (9);

wherein, prior to being held together by the sewn seam (10), when the first edge (8) and the second edge (9) are arranged on a plane in reciprocal contact at least at a contact point (11), at least the two first terminal tracts (8*a*, 9*a*) are separated from one another by a separation zone (12) which widens from the contact point (11) towards a lateral edge of the pocket, the pocket being further characterized in that the sewn seam (10) holds together the first edge (8) and the second edge (9) to thereby provide to the pocket a curved three-dimensional convex conformation effective to conform to a buttock region of a person wearing the trousers, wherein the seat region (16) comprises an upper flap (19) and a lower flap (20) connected by a second sewn seam (22), and wherein the sewn seam (10) of the pocket (1) overlaps and defines a prolongation of the second sewn seam (22).

2. The trousers of claim 1, wherein the piece of flat material forming the second portion (7) has a lower edge (3), a first lateral edge (4) and a second lateral edge (5), the first and second lateral edges (4, 5) of the piece of flat material forming the second portion (7) diverging from each other as they extend upward from the lower edge (3).

3. The trousers of claim 1, wherein the sewn seam (10) facilitates, at the separation zone (12), a union of the first portion (6) to the second portion (7) by a rotation of the first terminal tract (8*a*) of the first edge (8), with respect to the contact point (11), towards the first terminal tract (9*a*) of the second edge (9) until the two first terminal tracts (8*a*, 9*a*) are joined together.

4. The trousers of claim 1, wherein if, prior to being held together by the sewn seam (10), the first edge (8) and the second edge (9) are arranged on a plane in reciprocal contact at a second contact point (13), the second terminal tracts (8*b*, 9*b*) will be further separated from one another by a second separation zone (12'), which widens from the contact point (13) towards a second lateral edge (5) of the pocket.

5. The trousers of claim 4, wherein the second contact point (13) is part of a contact segment (13) which exhibits a first contact end (13*a*) and a second contact end (13*b*).

6. The trousers of claim 5, wherein the sewn seam (10) facilitates, at the first and second separation zones (12, 12'), union of the first portion (6) to the second portion (7) by rotation, with respect to the first contact end (13*a*), of the first terminal tract (8*a*) of the first edge (8) towards the first terminal tract (9*a*) of the second edge (9), and with respect to the second contact end (13*b*), of the second terminal tract (8*b*) of the first edge (8) towards the second terminal tract (9*b*) of the second edge (9), up to generating contact of the first and second terminal tracts (8*a*, 8*b*) of the first edge (8).

7. The trousers of claim 1, wherein the first portion (6) and the second portion (7) derive from two separate pieces of material which are joined by the sewn seam (10).

* * * * *